US006144824A

United States Patent [19]

Hashimoto et al.

[11] Patent Number: 6,144,824

[45] Date of Patent: Nov. 7, 2000

[54] IMAGE FORMING METHOD FOR PREVENTING AN UNEVEN POTENTIAL OF AN IMAGE BEARING MEMBER HAVING A CHARGE INJECTING LAYER

[75] Inventors: Kouichi Hashimoto, Numazu; Atsushi Takeda, Mishima; Fumiteru Gomi, Shizuoka-ken; Yoshiyuki Komiya, Mishima, all of Japan

[73] Assignee: Canon Kabushiki Kaisha, Tokyo, Japan

[21] Appl. No.: 09/386,172

[22] Filed: Aug. 31, 1999

[30] Foreign Application Priority Data

Sep. 1, 1998 [JP] Japan ..... 10-262390

[51] Int. Cl.[7] ..... G03G 15/00

[52] U.S. Cl. ..... 399/128; 399/43; 399/44; 399/149

[58] Field of Search ..... 399/38, 43, 44, 399/128, 149, 150, 159, 175, 252; 430/57, 100, 120, 122, 902

[56] References Cited

U.S. PATENT DOCUMENTS

| | | | |
|---|---|---|---|
| 5,701,559 | 12/1997 | Ootaka et al. | 399/149 |
| 5,933,681 | 8/1999 | Suzuki | 399/150 X |
| 5,970,285 | 10/1999 | Ito et al. | 399/149 |
| 6,064,837 | 5/2000 | Hashimoto et al. | 399/149 X |

FOREIGN PATENT DOCUMENTS

| | | |
|---|---|---|
| 6-3921 | 1/1994 | Japan . |
| 10-312102 | 11/1998 | Japan . |

*Primary Examiner*—Sophia S. Chen
*Attorney, Agent, or Firm*—Fitzpatrick, Cella, Harper & Scinto

[57] ABSTRACT

The present invention relates to an image forming method in which charges are injected into an image bearing member having a charge injecting layer on a surface thereof to thereby charge it to a predetermined polarity and charges of an opposite polarity to the predetermined polarity are imparted to the image bearing member before image formation.

10 Claims, 6 Drawing Sheets

IMAGE FORMING METHOD FOR PREVENTING AN UNEVEN POTENTIAL OF AN IMAGE BEARING MEMBER HAVING A CHARGE INJECTING LAYER

BACKGROUND OF THE INVENTION

1. Field of the Invention

This invention relates to an image forming method such as an electrophotographic method or an electrostatic recording method for use in an image forming apparatus such as a copying apparatus or a printer.

2. Related Background Art a) Contact Charging

In an image forming apparatus of the electrophotographic type or the electrostatic recording type or the like, a corona charger has heretofore been generally used as a charging means for charging an image bearing member such as an electrophotographic photosensitive body or an electrostatic recording dielectric body or other member to be charged to a predetermined polarity and potential.

This is such that a corona charger is disposed in non-contact and opposed relationship with an image bearing member (hereinafter referred to as the photosensitive body) and the surface of the photosensitive body is exposed to corona emitted from the corona charger to thereby charge the surface of the photosensitive body to a predetermined polarity and potential.

In recent years, due to advantages such as low ozone, low electric power, etc., as compared with a case using the corona charger of the above-described non-contact type, there has been put into practice a charging device of the contact type in which as previously described, a charging member (contact charging member) having a voltage (charging bias) applied thereto is made to abut against the photosensitive body as a member to be charged to thereby charge the surface of the photosensitive body to a predetermined polarity and potential.

Particularly, a device of a roller charging type using an electrically conductive roller (charging roller) as the contact charging member is preferably used from the viewpoint of the stability of charging.

Also, a magnetic brush charging member (a charging magnetic brush, hereinafter referred to as the magnetic brush charger) provided with a magnetic brush portion having magnetic particles magnetically restrained on a bearing member is used as the contact charging member, and a device of the magnetic brush charging type in which the magnetic brush portion of the magnetic brush charger is brought into contact with the photosensitive body is also preferably used from the viewpoint of the stability of charging contact.

The magnetic brush charger is formed with a magnetic brush portion by electrically conductive magnetic particles being directly magnetically restrained on a magnet or on a sleeve containing a magnet therein, the magnetic brush portion is stopped or rotated and brought into contact with the photosensitive body, and a voltage is applied thereto to thereby start the charging of the photosensitive body.

Also, a member provided with electrically conductive fibers formed into the shape of a brush (a fur brush charging member or a charging fur brush) or an electrically conductive rubber blade (a charging blade) comprising electrically conductive rubber formed into the shape of a blade is preferably used as the contact charging member.

Two kinds of charging mechanisms of the corona charging system and the charge injection charging (direct charging) system are each present in the charging mechanism (the mechanism of charging or the principle of charging) of contact charging, and the characteristic of each-of them appears depending on which is dominant.

The corona charging system is a system whereby the surface of the photosensitive body is charged with a discharge product by a corona discharge phenomenon occurring in the minute gap between the contact charging member and the photosensitive body. Corona charging has a constant discharge threshold value in the contact charging member and the photosensitive body and therefore, it is necessary to apply a voltage greater than charging potential to the contact charging member. Also, a discharge product is produced although markedly small in the quantity of production as compared with a corona charger.

The charge injection charging system is a system in which charges are directly injected from the contact charging member to the photosensitive body, whereby the surface of the photosensitive body is charged. More particularly, it is such that the contact charging member of medium resistance contacts with the surface of the photosensitive body and effects the direct injection of charges into the surface of the photosensitive body without the intermediary of a discharge phenomenon, i.e., basically without the use of discharge. Consequently, even if the applied voltage to the contact charging member is an applied voltage of a discharge threshold value or less, the photosensitive body can be charged to potential corresponding to the applied voltage. This charge injection charging system is not accompanied by the creation of ions.

However, due to injection charging (hereinafter referred to as the injection charging), the contacting property of the contact charging member with respect to the photosensitive body becomes greatly effective for the charging property. So, the contact charging member need adopt a construction which is constructed more densely and which has more speed difference from the photosensitive body and contacts with the photosensitive body with higher frequency, and in this point, as the contact charging member, particularly the magnetic brush charger can effect stable charging.

The injection charging by the magnetic brush charger can be regarded as being equivalent to a series circuit of a resistor and a capacitor. In an ideal charging process, a capacitor is charged for a time during which a certain point on the surface of the photosensitive body is in contact with the magnetic brush (the charging nip×the peripheral velocity of the photosensitive body) and the surface potential of the photosensitive body assumes substantially the same value as the applied voltage.

There is a method of applying a voltage to an electrically conductive contact charging member and injecting charges to a trap level on the surface of a photosensitive body to thereby effect the contact charging of the photosensitive body. Also, when as the photosensitive body, use is made of one having a surface layer (charge injecting layer) with electrically conductive particulates dispersed on an ordinary organic photosensitive body, or an amorphous silicon photosensitive body or the like, it is possible to obtain on the surface of a member to be charged charging potential substantially equal to a DC component in the bias applied to the contact charging member (Japanese Patent Application Laid-Open No. 6-3921).

There is also a known method of applying a voltage to an electrically conductive contact charging member, and injecting charges of the same polarity as the potential of a photosensitive body into the photosensitive body having, on the surface thereof, a charge injecting layer with electrically conductive powder ($SnO_2$ or the like) which is a trap level dispersed thereon to thereby effect contact charging.

The injection charging system is not only small in environment dependency but does not use discharge and therefore, the applied voltage to the contact charging member is sufficient if it is of the same degree as the potential of the photosensitive body, and also has the merit that ozone is not produced, and completely ozoneless and low electric power consumption type charging becomes possible.

b) Cleanerless Process (Toner Recycle Process)

Also, in recent years, downsizing has progressed in image forming apparatuses, but the general downsizing of an image forming apparatus has been limited if means and instruments for image forming processes such as charging, exposure, development, transfer, fixing and cleaning are simply made compact.

Also, any untransferred toner (residual developer) on the photosensitive body after transfer is collected by cleaning means (a cleaner) and becomes waste toner, but it is preferable from the viewpoint of the protection of environment that this waste toner not be discharged.

So, a "cleanerless process" image forming apparatus of a construction in which a cleaner is removed and any untransferred toner on a photosensitive body is removed from the photosensitive body by developing means in "cleaning simultaneous with development" and is collected and reused in the developing means has made its appearance. The cleaning simultaneous with development is a method of collecting some toner residual on the photosensitive body after transfer by a fog removing bias (a fog removing potential difference Vback which is the potential difference between a DC voltage applied to the developing means and the surface potential of the photosensitive body) during the development after the next step. According to this method, the untransferred toner is collected into the developing means and is used after the next step and therefore, waste toner can be done away with and the cumbersomeness of maintenance can be reduced. Also, being cleanerless has a great advantage in terms of space and the image forming apparatus can be made greatly compact.

Also, when the charging device for the photosensitive body is a contact charging device, the untransferred toner is once collected by a contact charging member which is in contact with the photosensitive body, and it is again discharged onto the photosensitive body and is collected by the developing device.

When the injection charging system and reversal developing are used together, a voltage of the polarity opposite to the charging potential is applied to the photosensitive body when a toner image on the photosensitive body is transferred to a transfer material such as paper, and as the result, charges of the opposite polarity are injected into the charge injecting layer on the surface of the photosensitive body.

Almost all of these charges of the opposite polarity are negated by charges of the same polarity injected by the charging device, but when the voltage of the transfer bias is high as compared with the voltage of the injection charging, some of the opposite charges remain in the charge injecting layer and reduce the potential of the photosensitive body. Particularly, the higher is the electrical resistance of the charge injecting layer and the greater is the layer thickness of the charge injecting layer and the lower is the charging capability of injection charging, the deeper portion reach the charges of the opposite polarity injected by transfer, whereas the charges of the same polarity of charging only reach the shallow portion of the charge injecting layer and therefore, the remains of charges of the opposite polarity become much.

A variation in the potential of the photosensitive body by image formation in such a case will now be described with reference to FIGS. 9A, 9B and 9C. In this system, the polarity of the photosensitive body 1 and toner t is the negative polarity. Consequently, the transfer bias is of the positive polarity.

FIG. 9A: this shows the state of the photosensitive body 1 after charging, exposure and development. Only the central portion is exposed, and the negative charges of the charge injecting layer have disappeared. The toner t is present only in that area (reversal developing).

FIG. 9B: the toner t shifts to the transfer material P by a transfer bias. At this time, an electric current flows from a transfer charger 5 to the photosensitive body 1, but since the area in which the toner is present is high in electrical resistance, the electric current flows more into the region around it where the toner is absent. As a result, more of positive charges are injected into the charge injecting layer of the area in which the toner is absent than into the area in which the toner is present.

FIG. 9C: by the injection of negative charges by the contact charging member 2A of a charging device (injection charger), negative charges are injected into the charge injecting layer of the photosensitive body 1, but by the difference in the amount of positive charges which were present in advance, the amount of negative charges in the charge injecting layer in the area wherein the toner t was absent becomes smaller than that in the area wherein the toner t was present. As a result, a difference occurs to the potential of the photosensitive body, and it appears as a density difference in the next image. That is, there occurs a so-called "negative ghost" in which the density of the area in which the toner is present is low.

This negative ghost does not disappear even in the resetting of the potential of the photosensitive body by pre-exposure effected before charging. This is because the work of the pre-exposure is the erasing of the charges of the same polarity as the potential.

Also, in the injection charging system and the cleanerless process, it is difficult to erase the above-mentioned negative ghost even by a pre-charger (to which a voltage of the polarity opposite to that of the photosensitive body is applied) used to charge the untransferred toner to the polarity opposite to that of the charging potential or remove the charges before injection charging, and efficiently effect the collection of the toner by injection charging. This is because the absolute value of the bias applied for the charging or the removal of the charges of the toner is at the same level as that of the charge injection charging bias and therefore it is difficult to inject opposite charges into the depth of the charge injecting layer as in the case of a transfer charger. The application of the same voltage as that during transfer results in the injection of a great deal of opposite charges into the charge injecting layer. When the charging capability of injection charging has lowered, charging cannot be done to desired potential and as the result, fog may be produced in the developing portion. Conversely, when in pre-charging, a voltage of the same magnitude as the transfer voltage and of the same polarity as the potential of the photosensitive body is applied to remove the charges of the opposite polarity in the charge injecting layer in advance, the untransferred toner is charged to the same polarity which is difficult to collect by the injection charger. Therefore, it is apparent that there occurs a positive ghost in which the toner-present area appears thickly in the image of the next round.

SUMMARY OF THE INVENTION

It is an object of the present invention to provide an image forming method which can uniformly effect injection charging.

It is another object of the present invention to provide an image forming method in which no ghost image is appeared.

It is still another object of the present invention to provide an image forming method having the steps of:

injecting charges into an image bearing member having a charge injecting layer on the surface thereof to thereby charge it to a predetermined polarity;

forming an electrostatic image on the charged image bearing member;

reversal-developing the electrostatic image;

electrostatically transferring the developed image on said image bearing member to a transfer material; and imparting charges of the polarity opposite to the predetermined polarity to said image bearing member before image formation.

Further objects of the present invention will become apparent from the following description.

DESCRIPTION OF THE PREFERRED EMBODIMENTS

<First Embodiment>

Figure 1:
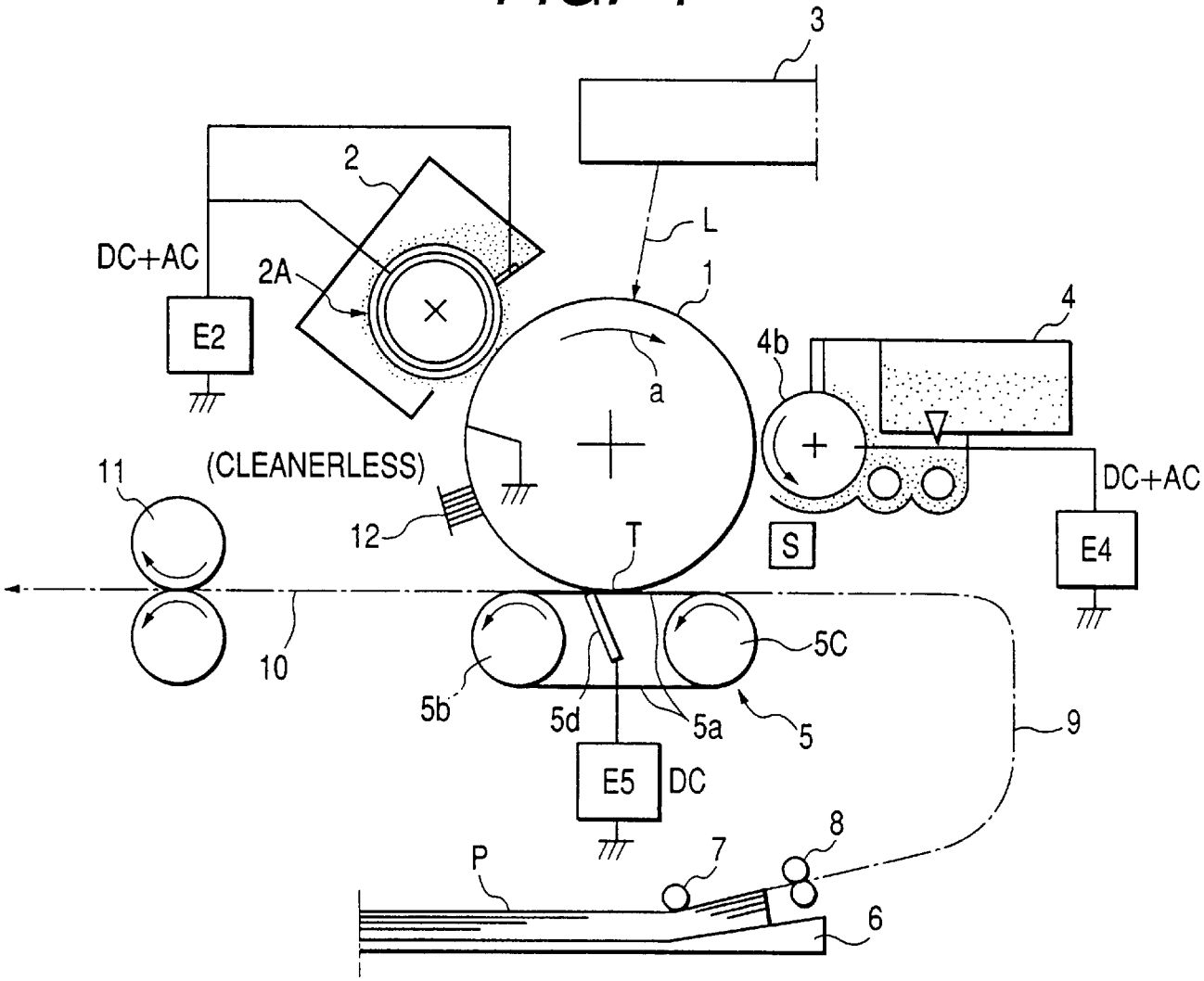
FIG. 1 schematically shows the construction of an image forming apparatus in a first embodiment of the present invention.

(1) Example of an Image Forming Apparatus (FIG. 1)

FIG. 1 schematically shows the construction of an example of an image forming apparatus. The image forming apparatus of the present embodiment is a laser beam printer utilizing the transfer type electrophotographic process, the charge injection charging system and the cleanerless process.

The reference numeral 1 designates a rotatable drum type electrophotographic photosensitive body (hereinafter referred to as the photosensitive drum) as an image bearing member. The photosensitive drum 1 in the present embodiment is an OPC photosensitive body of negative chargeability and charge injection chargeability (organic photoconductive photosensitive body) and is rotatively driven at a process speed (peripheral velocity) of 150 mm/sec. in the direction of arrow a.

The reference numeral 2 denotes a contact charging device for uniformly charging the surface of the photosensitive drum 1 to a predetermined polarity and potential. In the present embodiment, a magnetic brush charging device (injection charger), and the surface of the rotated photosensitive drum 1 is uniformly charged to nearly −700V in the charge injection charging system by this magnetic brush charging device 2.

The reference numeral 3 designates image information exposing means (exposure device) in the present embodiment, and it is a laser beam scanner. This laser beam scanner 3 comprises a semiconductor laser, a polygon mirror, an F-θ lens, etc., and emits a laser beam L modulated correspondingly to the time series electrical digital pixel signal of desired image information inputted from a host apparatus, not shown, such as an original reading apparatus having a photoelectric conversion element such as a CCD, an electronic computer or a word processor, and scans and exposes the uniformly charged surface of the rotatable photosensitive drum 1 by laser. By this laser beam scanning and exposure, an electrostatic latent image corresponding to the desired image information is formed on the peripheral surface of the rotatable photosensitive drum 1.

The reference numeral 4 denotes a developing apparatus. In the present embodiment, use is made of a developing apparatus of a two-component contact developing type using a developer comprising a mixture of a spherical nonmagnetic toner of a high parting property having little untransferred toner prepared by the polymerizing method and a magnetic carrier. The electrostatic latent image on the surface of the rotatable photosensitive drum 1 is reversal-developed as a toner image.

The reference numeral 5 designates a transfer device (transfer charger) disposed under the photosensitive drum 1, and in the present embodiment, this transfer device is of a transfer belt type. The reference character 5*a* denotes an endless transfer belt (e.g., a belt of polyimide having a thickness of 75 μm), and it is passed over a drive roller 5*b* and a driven roller 5*c* and is rotated in a forward direction which is the direction of rotation of the photosensitive drum 1 at substantially the same peripheral velocity as the rotational peripheral velocity of the photosensitive drum 1. The reference character 5*d* designates an electrically conductive blade disposed inside the transfer belt 5*a*, and the overlying belt portion of the transfer belt 5*a* is pressed against the lower surface portion of the photosensitive drum 1 to thereby form a transfer nip portion T as a transfer region.

The reference numeral 6 denotes a paper supply cassette containing a pile of transfer materials P (material to be transferred) such as paper therein. One of the transfer materials P stacked and contained in the paper supply cassette 6 is separated and fed by the driving of a paper feeding roller 7, and passes a sheet path 9 including conveying rollers 8, and is fed to the transfer nip portion T between the photosensitive drum 1 and the transfer belt 5*a* of the transfer device 5 at a predetermined control timing.

The transfer material P fed to the transfer nip portion T is pinched and conveyed between the rotatable photosensitive drum 1 and the transfer belt 5*a* and in the meantime, a predetermined transfer bias is applied from a transfer bias applying power source E5 to the electrically conductive blade 5*d*, and charging of the opposite polarity to the toner is done from the back of the transfer material P. Thereby, the toner image on the surface of the rotatable photosensitive drum 1 is electrostatically transferred to the surface of the transfer material P passing through the transfer nip portion T.

The transfer material P having passed through the transfer nip portion T and having had the toner image transferred thereto is separated from the surface of the rotatable photosensitive drum 1 and passes a sheet path 10 and is introduced into a fixing device (e.g., a heat roller fixing device) 11, whereby it has the toner image thereon fixed and is printed out.

The printer of the present embodiment utilizes a cleanerless process. Therefore is not disposed a cleaner exclusively used to remove any toner not transferred to the transfer material P at the transfer nip portion T but remaining on the surface of the rotatable photosensitive drum 1, but yet the untransferred toner, as will be described later, comes to the position of the magnetic brush charging device 2 by the continued rotation of the photosensitive drum 1 and is temporarily collected by the magnetic brush portion of the magnetic brush charger 2A as the contact charging member which is in contact with the photosensitive drum 1. The collected toner is again discharged to the surface of the photosensitive drum 1 and is finally collected into the developing apparatus 4, and the photosensitive drum 1 is repetitively used for image formation.

The reference numeral 12 designates an electrically conductive brush as a pre-charging device abutting against the surface of the photosensitive drum 1, between the transfer device 5, and the magnetic brush charging device 2, and a voltage (300V) opposite in polarity to the charging is applied thereto to thereby effect the removal of charges of the untransferred toner and the charging thereof to the opposite polarity. The applied bias to this brush 12 may be, besides a DC bias of the opposite polarity to the charging, an AC bias or a DC bias of the opposite polarity to the charging having an AC bias superposed thereon to obtain a similar effect. Also, a similar effect can be obtained by an electrically conductive blade, an electrically conductive film or the like in addition to the electrically conductive brush.

Figure 2:
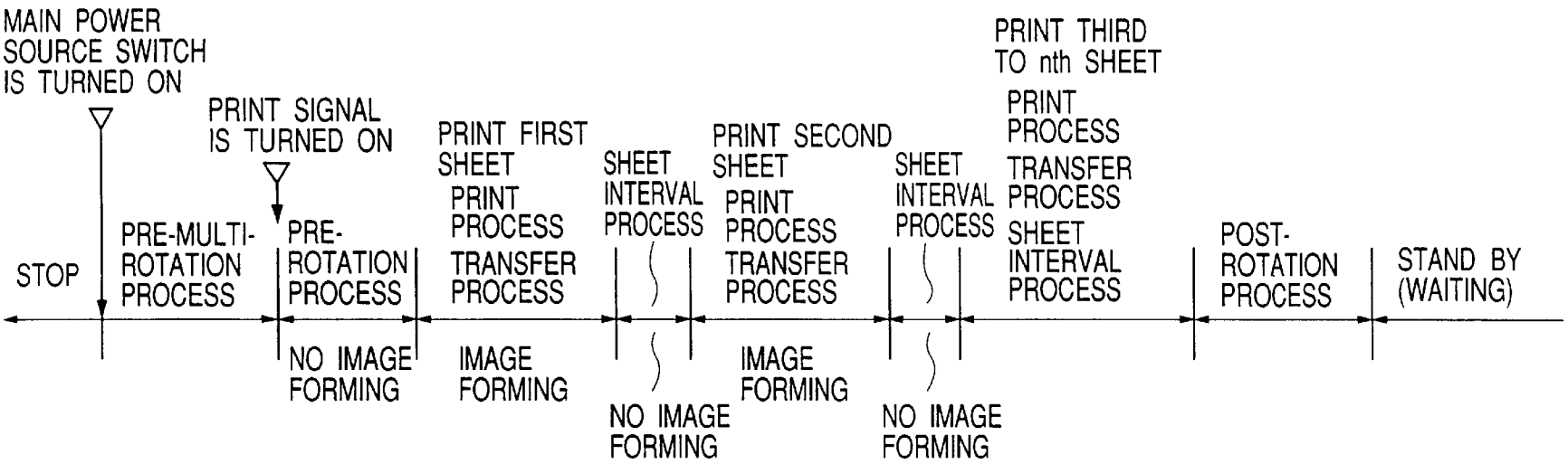
FIG. 2 is a diagram of the operation sequence of the image forming apparatus.

(2) Operation Sequence of the Printer (FIG. 2)

FIG. 2 is a diagram of the operation sequence of the printer.

(i). Pre-multi-rotation Process:

This is the starting operation period (actuating operation period or warming period) of the printer. By a main power source switch being turned on, the main motor of the apparatus is driven to thereby rotatively drive the photosensitive drum and execute the preparatory operation of a predetermined process instrument.

(ii). Pre-rotation Process:

This is a period for executing the print pre-operation. This pre-rotation process is executed continuously to the pre-multi-rotation process when a print signal is inputted during the pre-multi-rotation process. When there is not the input of the print signal, the driving of a main motor is once stopped after the termination of the pre-multi-rotation process, the rotative driving of the photosensitive drum is stopped, and the printer is kept in the standby (waiting) state until the print signal is inputted. When the print signal is inputted, the pre-rotation process is executed.

(iii). Print Process (Image Forming Process, Image Making Process):

When the predetermined pre-rotation process is terminated, the image making process for the rotatable photosensitive drum is continuously executed, and the transfer of the toner image formed on the surface of the rotatable photosensitive drum to the transfer material and the fixing of the toner image by the fixing means are done and an image-formed article is printed out.

In the case of continuous printing mode, the above-described print process is repeatedly executed by a predetermined set number n of prints.

(iv). Sheet Interval:

This is the non-passage period of the transfer material at the transfer nip portion in the continuous printing mode from after the trailing end portion of a transfer material has passed the transfer nip portion until the leading end portion of the next transfer material arrives at the transfer nip portion.

(v). Post-rotation Process:

This is a period for continuing the driving of the main motor for some time still after the print process for the nth sheet which is the last sheet has been terminated to thereby rotatively drive the photosensitive drum and execute a predetermined post-operation.

(vi). Standby:

When a predetermined post-rotation process is terminated, the driving of the main motor is stopped, the rotative driving of the photo-sensitive drum is stopped, and the printer is kept in its standby state until the next print start signal is inputted.

In the case of printing only one sheet, after the termination of the printing, the printer assumes its standby state via the post-rotation process.

When in the standby state, the print start signal is inputted, and the printer shifts to the pre-rotation process.

The time of the print process (iii) is the time of image formation, and the pre-multi-rotation process (i), the pre-rotation process (ii), the sheet interval process (iv) and the post-rotation process (v) are the time of non-image formation (the time of non-image making).

In the pre-multi-rotation process a and the post-rotation process (v), a cleaning bias of the same polarity as the charging polarity of the toner is applied to the electrically conductive blade 5*a* of the transfer device 5, whereby the toner adhering as stains to the transfer belt 5*a* shifts to the surface of the photosensitive drum and the cleaning of the transfer belt 5*a* is executed.

In the sheet interval process (iv), a sheet interval bias differing from the transfer bias in the print process (iii) is applied to the electrically conductive blade 5*d* of the transfer device 5.

Figure 3:
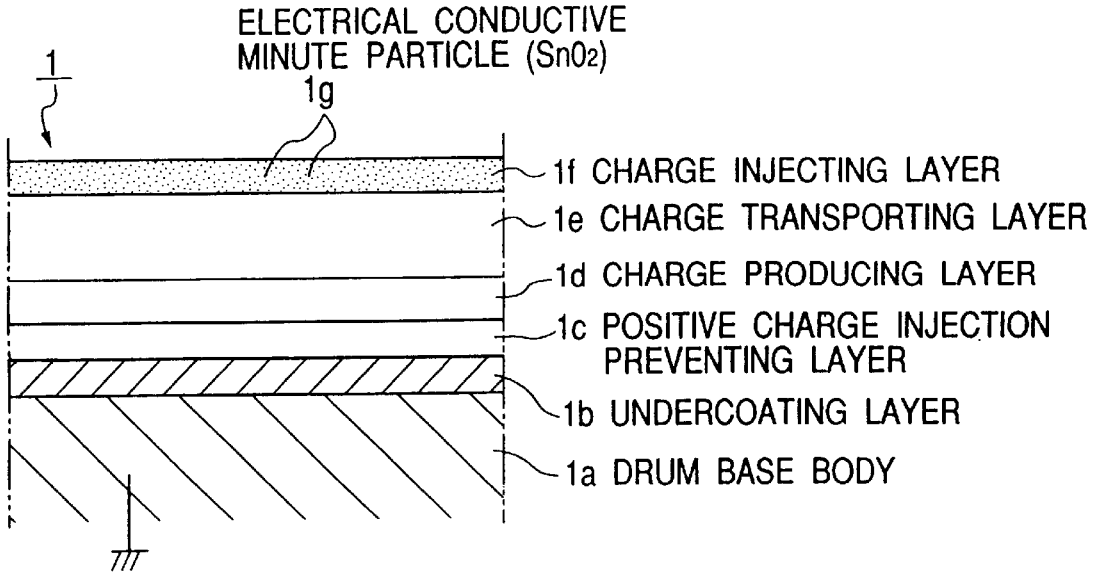
FIG. 3 is a model view showing the layer construction of a photosensitive body.

(3) Photosensitive Drum 1 (FIG. 3)

The photosensitive drum 1 in the present embodiment, as previously described, is an OPC photosensitive body of negative chargeability and charge injection chargeability, and as shown in the layer construction model view of FIG. 3, it comprises a drum base body 1*a* of $\phi$30 mm made of aluminum and first to fifth functional layers 1*b* through 1*f* provided thereon in succession from below.

First Layer 1*b*: This is an undercoating layer which is an electrically conductive layer having a thickness of about 20 $\mu$m provided to level the defect or the like of the aluminum drum base body 1*a* and to prevent the occurrence of moire due to the reflection of the laser exposure.

Second Layer 1*c*: This is a positive charge injection preventing layer which is a medium-resistance layer having a thickness of about 1 $\mu$m which performs the function of preventing positive charges injected from the aluminum drum base body 1*a* from negating negative charges charged on the surface of the photosensitive body and which was resistance-adjusted to the order of $10^6$ $\Omega$·cm by amilan resin and methoxymethylated nylon.

Third Layer 1*d*: This is a charge producing layer which is a layer having a thickness of about 0.3 $\mu$m and having a disazo pigment dispersed in resin, and produces a pair of positive and negative charges by being subjected to laser exposure.

Fourth Layer 1*e*: This is a charge transporting layer having hydrazone dispersed in polycarbonate resin, and is a P type semiconductor. Accordingly, negative charges charged on the surface of the photosensitive body cannot move in this layer, but only positive charges produced in the charge producing layer 1*d* can be transported to the surface of the photosensitive body.

Fifth Layer 1*f*: This is a charge injecting layer which is a coating layer of about 3 $\mu$m of a material in which antimony, which is a light-transmitting electrically conductive filler, is doped in photo-curing acryl resin as a binder and 70% by weight of super-particulates of 1*g* of tin oxide having a particle diameter of 0.03 μm and made low in resistance (made electrically conductive) is dispersed in resin. The electrical resistance value of this charge injecting layer 1*f* need be $1\times10^{10}$ to $1\times10^{14}\Omega\cdot$cm which is a condition of sufficient chargeability which does not cause the flow of image. In the present embodiment, use was made of a photosensitive drum having surface resistance of $1\times10^{11}\Omega\cdot$cm.

Figure 4:
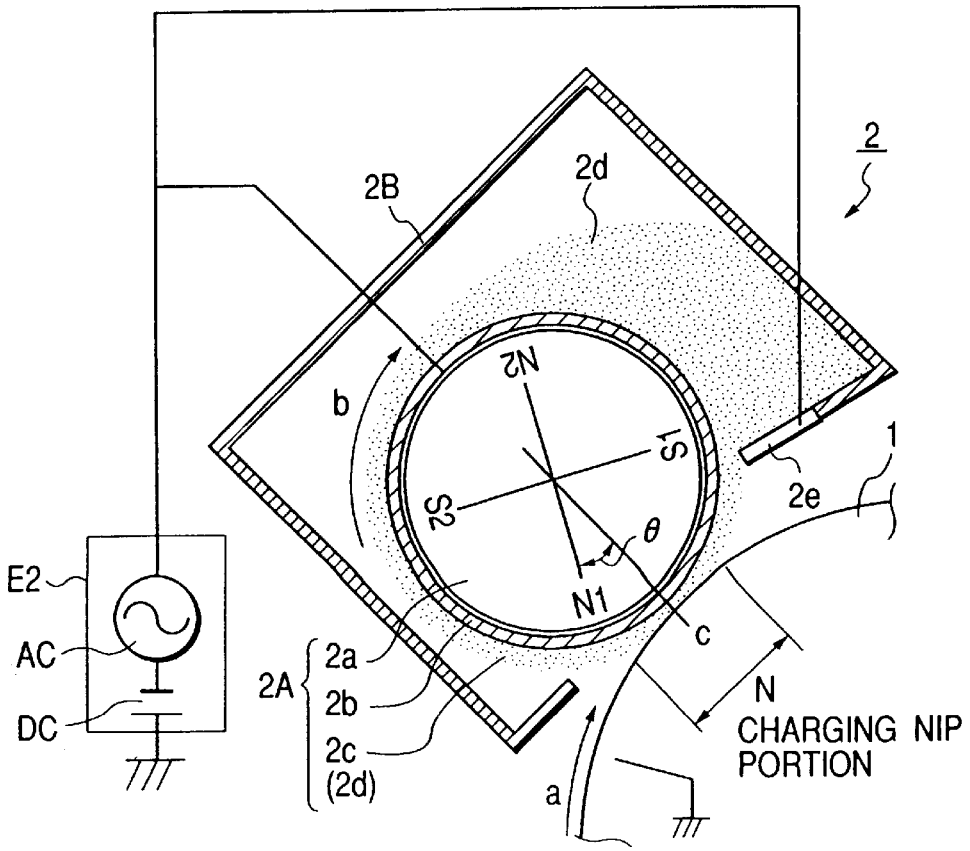
FIG. 4 is an enlarged transverse cross-sectional model view of a magnetic brush charging device.
Figure 5:
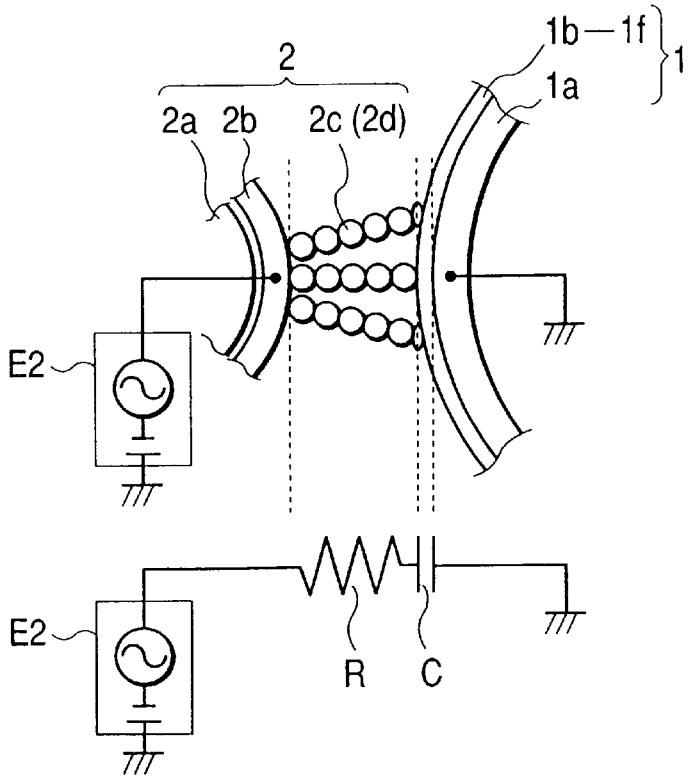
FIG. 5 is an equivalent circuit diagram of a charging circuit.
Figure 6:
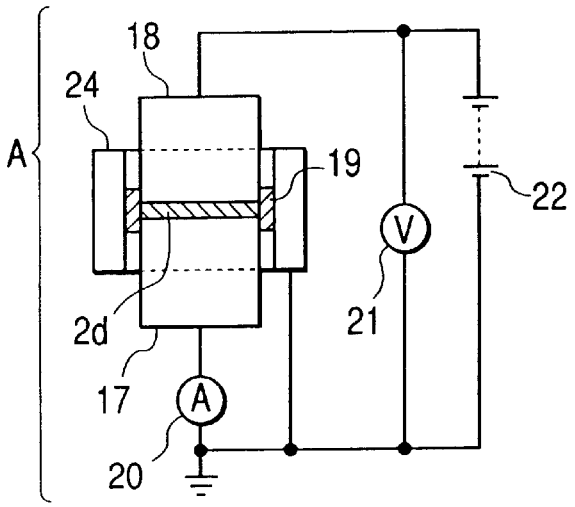
FIG. 6 is an illustration of the manner in which the electrical resistance value (volume resistance value) of magnetic particles (charged carrier) is measured.

(4) Magnetic Brush Charging Device 2 (FIGS. 4 to 6)

FIG. 4 is an enlarged transverse cross-sectional model view of the magnetic brush charging device 2. The magnetic brush charging device 2 in the present embodiment generally comprises a magnetic brush charging member (magnetic brush charger) 2A, a container (housing) 2B containing the magnetic brush charger 2A and electrically conductive magnetic particles (charging carrier) 2*d* therein, a charging bias applying power source E2 to the magnetic brush charger 2A, etc.

In the present embodiment, the magnetic brush charger 2A is of a sleeve rotation type, and comprises a magnet roll (magnet) 2*a*, a non-magnetic sleeve of stainless steel (referred to as the electrode sleeve, the electrically conductive sleeve or the charging sleeve) 2*b* fitted on the magnet roll 2*a*, and a magnetic brush portion 2*c* of magnetic particles 2*d* magnetically restrained and formed and held on the outer peripheral surface of the sleeve 2*b* by the magnetic force of the magnet roll 2*a* in the sleeve 2*b*.

The magnet roll 2*a* is a non-rotatable fixed member, and the sleeve 2*b* is rotatively driven around this magnet roll 2*a* in the clockwise direction of arrow b at a predetermined peripheral velocity, in the present embodiment, a peripheral velocity of 225 mm/sec., provided by a driving system, not shown. Also, the sleeve 2*b* is disposed in opposed relationship with the photosensitive drum 1 with a gap of the order of 500 μm kept therebetween by means such as a spacer roller.

The reference character 2*e* designates a magnetic brush layer thickness regulating blade of non-magnetic stainless steel attached to the container 2B and disposed so that the gap between it and the surface of the sleeve 2*b* may be 900 μm.

Some of the magnetic particles 2*d* in the container 2B are magnetically restrained on the outer peripheral surface of the sleeve 2*b* by the magnetic force of the magnet roll 2*a* in the sleeve and are held as a magnetic brush portion 2*c*. The magnetic brush portion 2*c* is rotated in the same direction as the sleeve 2*b* with the sleeve 2*b* with the rotative driving of the sleeve 2*b*. At this time, the layer thickness of the magnetic brush portion 2*c* is regulated to a uniform thickness by the blade 2*e*. Since the regulated layer thickness of the magnetic brush portion 2*c* is greater than the interval of the gap portion between the sleeve 2*b* and the photosensitive drum 1 opposed to each other, the magnetic brush portion 2*c* forms a nip portion of a predetermined width with respect to the photosensitive drum 1 in the opposed portion of the sleeve 2*b* and the photosensitive drum 1 and contacts therewith. This contact nip portion is a charging nip portion N. Accordingly, the rotatable photosensitive drum 1 is rubbed against by the magnetic brush portion 2*c* rotated with the rotation of the sleeve 2*b* of the magnetic brush charger 2A at the charging nip portion N. In this case, at the charging nip portion N, the direction of movement of the photosensitive drum 1 and the direction of movement of the magnetic brush portion 2*c* become opposite to each other and the relative movement speed thereof becomes higher.

A predetermined charging bias is applied from a power source E2 to the sleeve 2*b* and the magnetic brush layer thickness regulating blade 2*e*.

Thus, the photosensitive drum 1 is rolatively driven, the sleeve 2*b* of the magnetic brush charger 2A is rotatively driven and a predetermined charging bias is applied from the power source E2, whereby in the case of the present embodiment, the peripheral surface of the photosensitive drum 1 is uniformly contact-charged to a predetermined polarity and potential by the charge injection charging system.

The magnet roll 2*a* fixedly disposed in the sleeve 2*b* has a magnetic pole (main pole) N1 of about 900G disposed at a position of 10° upstream of the closest position c of the sleeve 2*b* and the photosensitive drum 1 with respect to the direction of rotation of the photosensitive drum. Also shown in poles S1, S2 and N2.

As regards this main pole N1, it is desirable that the angle θ with the closest position c of the sleeve 2*b* and the photosensitive drum 1 be within the range of 20° upstream to 10° downstream with respect to the direction of rotation of the photosensitive drum, and is more desirably 15° to 0° upstream. If more downstream than it, magnetic particles are attracted to the main pole position and the stagnation of the magnetic particles is liable to occur downstream of the charging nip portion N with respect to the direction of rotation of the photosensitive drum, and if too upstream, the carrying property of the magnetic particles passed through the charging nip portion N becomes bad and the stagnation thereof is liable to occur.

Also, when there is not magnetic pole in the charging nip portion N, it is apparent that a restraining force to the sleeve 2*b* acting on the magnetic particles becomes weak and the magnetic particles are liable to adhere to the photosensitive drum 1.

The charging nip portion N described herein refers to an area in which during charging, the magnetic particles of the magnetic brush portion 2*c* are in contact with the photosensitive drum 1.

The charging bias is applied to the sleeve 2*b* and the regulating blade 2*e* by the power source E2. In the present embodiment, use is made of a bias comprising an AC component superposed and DC component.

By the frictional sliding of the magnetic brush portion 2*c* of the magnetic brush charger 2A against the surface of the photosensitive drum 1 in the charging nip portion N and the application of the charging bias to the magnetic brush charger 2A, charges are imparted from the charging magnetic particles 2*d* constituting the magnetic brush portion 2*c* onto the photosensitive drum 1, and the surface of the photosensitive drum 1 is uniformly contact-charged to a predetermined polarity and potential. In the case of the present embodiment, the photosensitive drum 1 is provided with the charge injection layer 1*f* on the surface thereof and therefore, the charging of the photosensitive drum 1 is done by charge injection charging. That is, the surface of the photosensitive drum 1 is charged to potential corresponding to the DC component of the charging bias DC+AC. The sleeve 2*b* tends to become better in charging uniformity as the rotational speed thereof becomes higher.

The charge injection charging of the photosensitive drum 1 by the magnetic brush charger can be regarded as the circuit of a resistor R and a capacitor C as shown in the equivalent circuit of FIG. 5. In the case of such a circuit, when the resistance value is defined as r, the electrostatic capacity of the photosensitive body is defined as $C_p$, the applied voltage is defined $V_0$ and the charging time (the time when a certain point on the photosensitive drum passes through the charging nip portion N) is defined $t_0$, the surface potential Vd of the photosensitive drum is represented by the following expression (1):

$$Vd=V_0(1-\exp(t_0/(C_p\cdot r))) \quad (1)$$

In the charging bias DC+AC, the DC component was the same value as the required surface potential of the photosensitive drum 1, in the present embodiment, −700V.

The peak-to-peak voltage $V_{pp}$ of the AC component during image formation (image making) may preferably be 100V or greater to 2000V or less, and more preferably be 300V or greater to 1200V or less. If the peak-to-peak voltage $V_{pp}$, is less than that, the effect of improvements in charging uniformity and the rising property of potential is small, and if the peak-to-peak voltage $V_{pp}$ is greater than that, the stagnation of the magnetic particles and the adherence thereof to the photosensitive drum are aggravated.

The frequency may preferably be 100 Hz or greater to 5000 Hz or less, and more preferably be 500 Hz or greater to 2000 Hz or less. If the frequency is less than that, the adherence of the magnetic particles to the photosensitive drum is aggravated and the effect of improvements in charging uniformity and the rising property of potential becomes small, and if the frequency is greater than that, it becomes difficult to obtain the effect of improvements in charging uniformity and the rising property of potential.

The waveform of the AC component may preferably be a rectangular wave, a triangular wave, a sine wave or the like.

While in the present embodiment, a sintered ferromagnetic material (ferrite) which was reduced was used as the magnetic particles 2*d* constituting the magnetic brush portion 2*c*, use can likewise be made of resin and ferromagnetic material powder mixed and shaped into a particle shape or electrically conductive carbon or the like mixed therewith for the adjustment of the resistance value thereof, or subjected to surface processing.

The magnetic particles 2*d* of the magnetic brush portion 2*c* must have both of the role of injecting charges well into the trap level of the surface of the photosensitive drum and the role of preventing the power supply destruction of the charging member and the photosensitive drum caused due to a charging current concentrating in such a defect as a pinhole created on the photosensitive drum.

Accordingly, the resistance value of the magnetic brush charger 2A may preferably be $1\times10^4\Omega$ to $1\times10^9\Omega$, and more preferably be $1\times10^4\ \Omega$ to $1\times10^7\ \Omega$. If the resistance value of the magnetic brush charger 2A is less than $1\times10^4\Omega$, pinhole leak tends to become liable to occur, and if it exceeds $1\times10^9\Omega$, it tends to become difficult to effect good injection of charges. Also, to control the resistance value within the above-mentioned range, the volume resistance value of the magnetic particles 2*d* may preferably be $1\times10^4\Omega\cdot$cm to $1\times10^9\Omega\cdot$cm, and more preferably be $1\times10^4\Omega\cdot$cm to $1\times10^7\Omega\cdot$cm.

The resistance value of the magnetic brush charger 2A used in the present embodiment is $1\times10^6\Omega\cdot$cm, and −700V was applied as the DC component of the charging bias, whereby the surface potential of the photosensitive drum 1 also became −700V.

The volume resistance value of the magnetic particles 2*d* was measured in the manner shown in FIG. 6. That is, a cell A was filled with the magnetic particles 2*d*, and a main electrode 17 and an upper electrode 18 were disposed so as to contact with the filling magnetic particles 2*d*, and a voltage was applied from a constant voltage source 22 to between the electrodes 17 and 18, and an electric current flowing at that time was measured by an ammeter 20 to thereby find the volume resistance value of the magnetic particles 2*d*. The reference numeral 19 designates an insulating material, the reference numeral 21 denotes a voltmeter, and the reference numeral 24 designates a guide ring.

The measuring conditions are an environment of 23° C. and 65%, the area of contact S of the filling magnetic particles 2*d* with the cell S=2 $cm^2$, the thickness d=1 mm, the load of the upper electrode 18 of 10 kg, and the applied voltage of 100V.

It is preferable from the viewpoint of the prevention of the deterioration of charging by the contamination of the surfaces of the particles that the peak in the measurement of the average particle diameter and particle size distribution of the magnetic particles 2*d* be within the range of 5 to 100 $\mu$m.

The average particle diameter of the magnetic particles 2*d* is shown by the horizontal maximum chord length, and the measuring method is to choose the abnormality of 300 magnetic particles at random by the microscopic method, and actually measure the diameter thereof and take the arithmetical mean.

Figure 7:
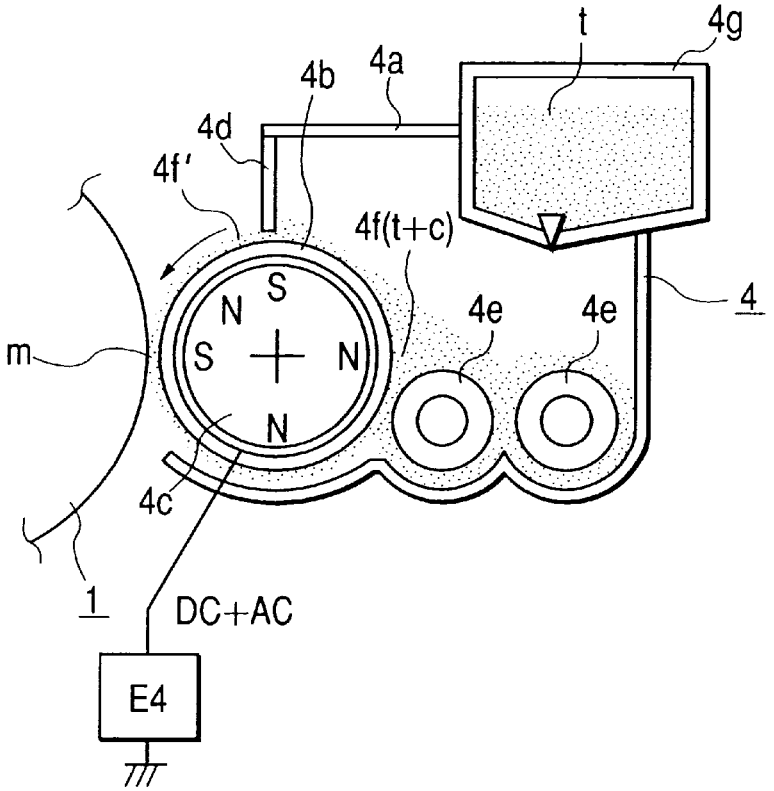
FIG. 7 is an enlarged transverse cross-sectional model view of a developing device.

(5) Developing Apparatus 4 (FIG. 7)

The toner developing method for the electrostatic latent image is divided broadly into the following four kinds 1 to 4.

(1) A method of coating the sleeve with a nonmagnetic toner by a blade or the like, or coating the sleeve with a magnetic toner by a magnetic force and carrying the toner, and developing in a non-contact state with respect to the photosensitive body. (monocomponent non-contact development)

(2) A method of developing with the toner which has been applied in the above-described manner being in a contact state with respect to the photosensitive body. (monocomponent contact development)

(3) A method of using a mixture of toner particles and a magnetic carrier as a developer and carrying it by a magnetic force, and developing in a contact state with respect to the photosensitive body. (two-component contact development)

(4) A method of developing with the above-mentioned two-component developer being in a non-contact state. (two-component non-contact development)

Among these methods, the two-component contact developing method c is often used from the viewpoints of the higher quality and higher stability of image.

FIG. 7 is an enlarged transverse cross-sectional model view of the developing apparatus 4 used in the present embodiment. The developing apparatus 4 in the present embodiment is a reversal developing apparatus of a two-component magnetic brush contact developing type which uses as a developer a mixture of a high parting property spherical nonmagnetic toner and a magnetic carrier (developing magnetic particles and developing carrier) made by the polymerizing method, and holds the developer as a magnetic brush layer on a developer bearing body (a developing member or a developing device) by a magnetic force carries it to a developing portion, and brings it into contact with the surface of the photosensitive drum to thereby develop the electrostatic latent image as a toner image.

The reference character 4*a* designates a developing container, the reference character 4*b* denotes a developing sleeve as a developer bearing body, the reference character 4*c* designates a magnet (magnet roller) as magnetic field producing means fixedly disposed in the developing sleeve 4*b*, the reference character 4*d* denotes a developer layer thickness regulating blade for forming a thin layer of developer on the surface of the developing sleeve, the reference character 4*e* designates a developer agitating and carrying screw, and the reference character 4*f* denotes a two-component developer contained in the developing container 4*a* and comprising a mixture of a non-magnetic toner t and a developing carrier c as described above.

During at least development, the developing sleeve 4*b* is disposed so that its closest distance (gap) to the photosensitive drum 1 may be about 500 μm, and is set so that a developer magnetic brush thin layer 4*f'* borne on the outer surface of the developing sleeve 4*b*may contact with the surface of the photosensitive drum 1. The contact nip portion m between this developer magnetic brush thin layer 4*f'* and the photosensitive drum 1 is a developing area (developing portion).

The developing sleeve 4*b* is driven in the counter-clockwise direction of arrow around the fixed magnet 4*c* therein at a predetermined rotational speed, and in the developing container 4*a*, a magnetic brush of the developer 4*f* (t+c) is formed on the outer surface of the sleeve by the magnetic force of the fixed magnet 4*c*. The developer magnetic brush is carried with the rotation of the sleeve 4*b*, is subjected to layer thickness regulation by the blade 4*d*, is taken out of the developing container as a developer magnetic brush thin layer 4*f'* of a predetermined layer thickness, and is carried to the developing portion m and contacts with the surface of the photosensitive drum 1, and is carried back into the developing container 4*a* by the continued rotation of the sleeve 4*b*.

A predetermined developing bias comprising a DC component and an AC component superposed one upon the other is applied to the developing sleeve 4*b* by a developing bias applying power source E4. The developing characteristic in the present embodiment is such that when the difference between the charging potential (−700V) of the photosensitive drum 1 and the DC component value of the developing bias was 200V or less, fog appeared, and when said difference is 350V or greater, the adherence of the developing carrier c to the photosensitive drum 1 occurred and therefore, the DC component of the developing bias was −400V.

As regards the toner density (the mix rate with the developing carrier c) of the developer 4*f* (t+c) in the developing container 4*a*, the toner is consumed by the development of the electrostatic latent image and decreases sequentially. The toner density of the developer 4*f* in the developing container 4*a* is detected by detecting means, not shown, and when it lowers to predetermined allowable lower limit density, the toner t is supplied from a toner supplying portion 4*g* to the developer 4*f* in the developing container 4*a*. The toner supply is controlled so as to always keep the toner density of the developer 4*f* in the developing container 4*a* within a predetermined allowable range.

(6) Cleanerless Process

Since the printer of the present embodiment utilizes the cleanerless process, the residual toner (untransferred toner) on the photosensitive drum 1, after the transfer of the toner image to the transfer material P, is carried to the charging nip portion N of the photosensitive drum 1, and is mixed with the magnetic brush portion 2*c* of the magnetic brush charger 2A of the magnetic brush contact charging device 2 and is temporarily collected.

It is often the case that the untransferred toner on the photosensitive drum 1 comprises a mixture of a toner of positive polarity and a toner of negative polarity. This untransferred toner comprising a mixture of toners of different polarities comes to the magnetic brush charger 2A, and is mixed with the magnetic brush portion 2*c* and is temporarily collected.

The introduction of this untransferred toner into the magnetic brush portion 2*c* of the magnetic brush charger 2A can be effected more effectively by applying an AC component to the magnetic brush charger 2A to thereby produce an oscillation electric field effect between the magnetic brush charger 2A and the photosensitive drum 1.

Then, the untransferred toner introduced into the magnetic brush portion 2*c* is all charged to the negative polarity and is discharged onto the photosensitive drum 1. The untransferred toner discharged onto the photosensitive drum 1 with its polarities uniformized comes to the developing portion m and is collected by the developing device 4*b* of the developing apparatus 4 with the aid of the fog removing electric field during development in the cleaning simultaneous with development.

The collection simultaneous with development of this untransferred toner is effected concurrently with other image forming steps such as charging, exposure, development and transfer, when the image area in the direction of rotation is longer than the peripheral length of the photosensitive drum 1.

Thereby, the untransferred toner is collected into the developing apparatus 4 and is also used after the next step and therefore, waste toner can be eliminated. Also, the advantage in terms of space is great, and the image forming apparatus can be greatly downsized.

By the high parting property spherical toner made by the polymerizing method being used as the toner t of the developer, the amount of production of untransferred toner can be reduced and the collectability of the toner discharged from the magnetic brush charger 2A into the developing apparatus 4 can be improved. Also by using the developing apparatus 4 of the two-component contact developing type, the collectability of the toner discharged from the magnetic brush charger 2A into the developing apparatus 4 is improved.

Usually the toner is relatively high in electrical resistance and therefore, it is a factor which makes the resistance of the magnetic brush portion 2*c* rise and reduces the charging ability thereof for such toner particles to mix with the magnetic brush portion 2*c* of the magnetic brush charger 2A. But the quantity of untransferred toner produced in the ordinary image forming process and carried to the charging nip portion N and mixing with the magnetic brush portion 2*c* of the magnetic brush charging member 2A is slight. The discharge of the mixing toner from the magnetic brush portion 2*c* is done smoothly, and the allowable amount for the toner mixing with the magnetic brush portion 2*c* is relatively great. Therefore, there is no problem in practice.

The toner discharged from the magnetic brush portion 2*c* to the photosensitive drum 1 is in a very uniformly scattered state and the quantity thereof is small. Therefore substantially it does not adversely affect the next image exposing process. A ghost image attributable to the untransferred toner pattern does not appear.

(7) Application of Transfer Bias Before Image Making

In the above-described apparatus construction, before image making, the photosensitive drum 1 was caused to make one round and a transfer current (constant current control) was varied to thereby examine the presence or absence of a negative ghost.

An electrostatic image of characters or solid is formed on the photosensitive drum, whereafter a transfer current corresponding to one round of the photosensitive drum is imparted.

Figure 8:
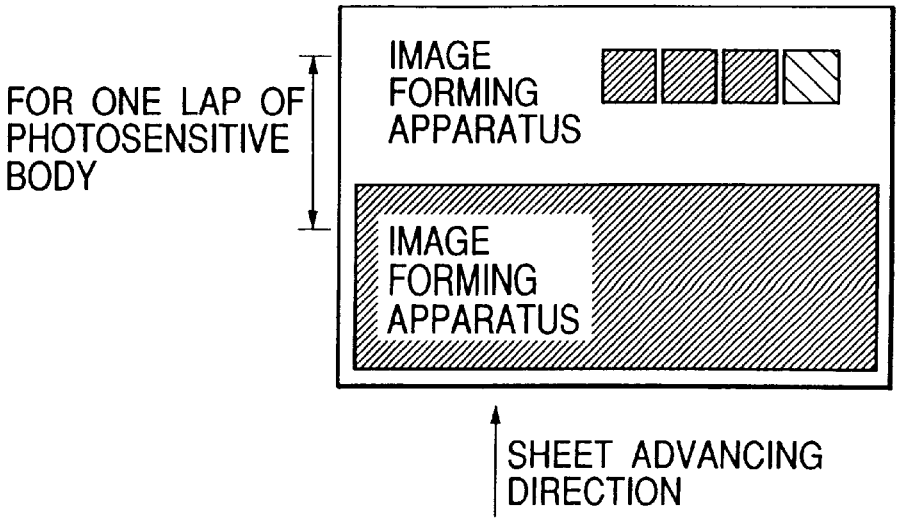
FIG. 8 shows an image for evaluating a negative ghost.
Figure 9A:
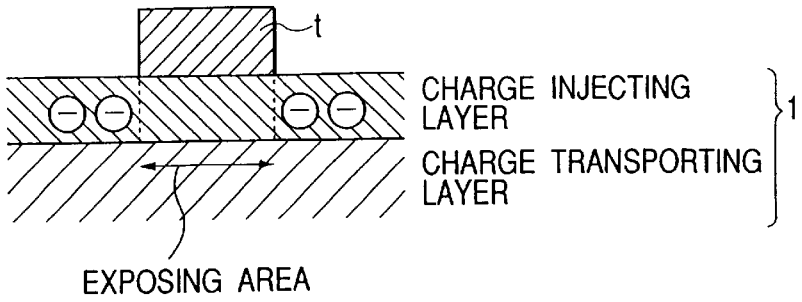
FIGS. 9A, 9B and 9C show a mechanism by which the negative ghost is appeared.
Figure 9B:
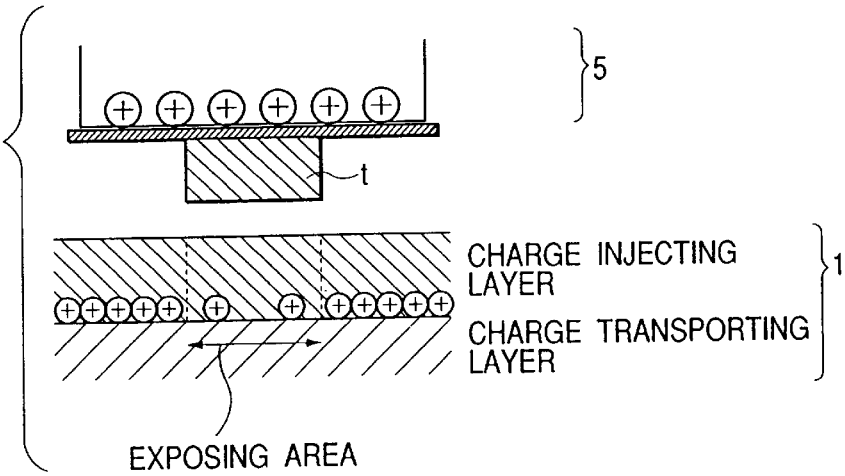
Figure 9C:
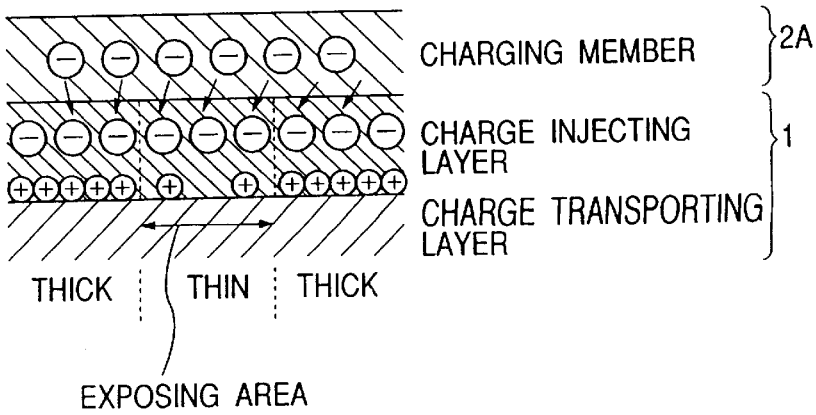

Thereafter, evaluation was made in an image (FIG. 8) wherein a half tone of image duty 40% is disposed. The result is shown in Table 1 below.

TABLE 1

| transfer current | 0 μA | 2.5 μA | 5.0 μA | 7.5 μA | 10 μA | 12.5 μA | 15 μA |
|---|---|---|---|---|---|---|---|
| negative ghost | present | somewhat present | somewhat present | absent | absent | absent | absent |

By charges of the opposite polarity to the primary charging polarity being thus injected into the photosensitive body before image making, the negative ghost is improved.

Particularly, by the absolute value of the voltage of the transfer bias applied before image making being made greater than the absolute value of the voltage applied to the charging member, the charges injected into the photosensitive body becomes uniform and the creation of a negative ghost is prevented.

When as in the present embodiment, an oscillation voltage comprising an AC component superposed on a DC component is applied to the charging member, it is preferable to make the absolute value of the transfer bias applied before image making greater than the absolute value of the peak value of the oscillation voltage.

<Second Embodiment>

In this embodiment, after the completion of image making, a transfer bias corresponding to one round of the photosensitive drum 1 was applied, whereafter the presence or absence of a negative ghost was examined by the time for which it was left as it was. The evaluating method is the same as that in the first embodiment. The result is shown in Table 2 below.

TABLE 2

| time for which it was left as it was | 0 min. | 15 min. | 30 min. | 45 min. | 60 min. | 75 min. | 90 min. |
|---|---|---|---|---|---|---|---|
| negative ghost | absent | absent | absent | absent | present | present | present |

From this result, it will be seen that in the system used in the present embodiment, a negative ghost can be prevented if the application of a transfer bias at the first one round is effected only after it is left as it is for 45 minutes.

That is, means for detecting the time for which it is left as it is after the last image making (a timepiece function portion or a time limit function portion) is provided in the control system of the apparatus, whereby the application of the transfer bias before each image making time can be prevented to thereby shorten the first copy time.

Also, by providing environment detecting means such as a temperature-humidity sensors, (FIG. 1) the operation of applying a transfer bias at the first one round can be prevented in a high humidity environment wherein it is difficult for a negative ghost to occur or the like (the resistance of the charge injecting layer lowers, and when the transfer bias is constant current control, the transfer voltage lowers) and likewise, the first copy time can be shortened.

<Third Embodiment>

When in this embodiment, the bias applied to the electrically conductive brush 12 instead of the transfer bias was +5 kV only for one round of the photosensitive drum before image making and evaluation similar to that in the first embodiment was made, the appearance of a negative ghost could be prevented. The voltage applied to the electrically conductive brush 12 may desirably be of the same degree of value as the transfer voltage in order to bring the injectability of positive charges to the same level as transfer.

<Fourth Embodiment>

When in this embodiment, the bias applied to the injection charger 2A instead of the transfer bias was +5 kV only for one round of the photosensitive drum before image making and evaluation similar to that in the first embodiment was made, the appearance of a negative ghost could be prevented. The voltage applied to the injection charger 2A may desirably be of the same degree of value as the transfer voltage in order to bring the injectability of positive charges to the same level as transfer. Also, it is apparent that the injection of positive charges into the charge injecting layer before image making can be done by a combination of the transfer charger 5, the electrically conductive brush 12 and the injection charger 2A to obtain a similar effect.

<Others>

1) The magnetic brush charger 2A as the contact charging member is not limited to a sleeve rotation type, but can also be of a construction in which a magnet roll is rotated or a construction in which the surface of a magnet roll is electrically conductively processed as a power supplying electrode as required and electrically conductive magnetic particles are directly magnetically restrained on the outer peripheral surface of the magnet roll to thereby form a magnetic brush portion, and the magnet roll is rotated. It can also be a magnetic brush charging member of a type which is not rotated.

2) The contact charging member may also be a fur brush charging member or a charging roller using electrically conductive rubber or electrically conductive sponge, and again in such case, it may be of a type which is not rotated.

3) The photosensitive body as an image bearing member can realize charge injection charging if it has a low-resistance layer having surface resistance of $10^9$ to $10^{14}\Omega\cdot$cm. This is desirable from the viewpoint of the prevention of the production of ozone, but use may also be made of other organic photosensitive body. That is, contact charging is not limited to the charge injection charging system of the embodiments, but may be a contact charging system in which the discharge phenomenon is dominant.

4) While the developing apparatus has been described with respect only to the two-component developing method, other developing methods may also be adopted. Preferably, monocomponent contact development or two-component contact development for developing a latent image with the developer brought into contact with the photosensitive body is more effective to heighten the simultaneous collecting effect of the developer.

Also, when a polymeric toner is used as the toner particles in the developer, a sufficient collecting effect is obtained in the above-mentioned monocomponent contact development and two-component contact development as well as in other developing methods such as monocomponent non-contact development and two-component non-contact development.

The developing apparatus may be of the reversal developing type or the regular developing type.

5) As the waveform of AC (alternating voltage or AC voltage), use can suitably be made of a sine wave, a rectangular wave, a triangular wave or the like. Also, there may be a rectangle formed by a DC voltage source being periodically turned on/off. Thus, as the waveform of the alternating voltage, use can be made of such a bias of which the voltage value changes periodically.

6) The image making process of the image forming apparatus is not restricted to the embodiments, but is arbitrary. Also, other auxiliary process instrument may be added as required.

The image exposure means for the formation of an electrostatic latent image is not restricted to the laser scanning exposure means for forming a digital latent image as in the embodiments, but may also be other light-emitting element such as ordinary analogous image exposure or LED, or any means which can form an electrostatic latent image corresponding to image information, such as a combination of a light-emitting element such as a fluorescent lamp and a liquid crystal shutter.

7) The transfer material for receiving the transfer of a toner image from the image bearing member may be an intermediate transfer member such as a transfer drum.

8) The transferring means is not restricted to the transfer belt device in the embodiments, but may be any one, such as corona discharge transfer, roller transfer or blade transfer.

9) While the image forming apparatus of the embodiments is for the formation of black and white images, a photosensitive body, a charging device, a developing apparatus and an exposure device may be provided for each of yellow, magenta, cyan and black and toner images on the respective photosensitive bodies can be successively transferred to a transfer material by a belt or a cylindrical transfer material holding body to thereby obtain a full-color image.

That is, the present invention can be applied not only to monochromatic image formation by the use of an intermediate transfer member such as a transfer drum or a transfer belt, but also to an image forming apparatus for forming polychromatic or full-color images by multiplex transfer or the like.

10) The image forming apparatus is not restricted to one utilizing the cleanerless process, but may be an image forming apparatus provided with a cleaning device (cleaner) used exclusively for removing any untransferred toner from the surface of the photosensitive body after transfer.

11) Any process instruments such as the image bearing member 1, the charging device 2 and the developing apparatus 4 can also be made into an apparatus construction of a detachably attachable process cartridge type collectively interchangeable with respect to the main body of the image forming apparatus.

12) There is also an image display apparatus in which the electrophotographic photosensitive body or an electrostatic recording dielectric body as the image bearing member is made into a rotatable belt type and a toner image corresponding to image information is formed thereon by the step means for charging, electrostatic latent image formation and developing, and the toner image forming portion is located on a perusing display portion to thereby display the image, and the image bearing member is repetitively used for the formation of display images. In the present invention, the image forming apparatus also covers such an image display apparatus.

While the embodiments of the present invention have been described above, the present invention is not restricted to these embodiments, but all modifications are possible within the technical idea of the invention.

What is claimed is:

1. An image forming method comprising the steps of:

an image formation preprocessing step; and an image forming step effected successively after said image formation preprocessing step, said image forming step including the steps of:

injecting charges into an image bearing member having a charge injecting layer on a surface thereof to thereby charge it to a predetermine polarity;

forming an electrostatic image on the charged image bearing member;

reversal-developing the electrostatic image;

electrostatically transferring the developed image on said image bearing member to a transfer material; and wherein in said image formation preprocessing step, charges of a polarity opposite to the predetermined polarity are imparted over an entire circumference of said image bearing member.

2. An image forming method according to claim 1, the imparting of the charges of the opposite polarity during said image formation preprocessing step is effected by a transfer charger for transferring the developed image to the transfer material.

3. An image forming method according to claim 2, wherein said transfer charger is close contacted with the image bearing member.

4. An image forming method according to claim 1, wherein the imparting of the charges of the opposite polarity during said image formation preprocessing step is effected by an electrically conductive member provided between a transfer portion and a charging portion and contacting with the image bearing member.

5. An image forming method according to claim 1, wherein a voltage applied to an imparting member for imparting the charges of the opposite polarity to the predetermined polarity to said image bearing member during said image formation preprocessing step is greater in absolute value than a voltage applied to a charging member for injecting charges into said image bearing member.

6. An image forming method according to claim 5, wherein an oscillation voltage is applied to said charging member, and the voltage applied to said imparting member is greater in absolute value than a peak value of the oscillation voltage.

7. An image forming method according to claim 1, wherein a time for which the charges of the opposite polarity to the predetermined polarity is imparted to said image bearing member is integer times a time required for said image bearing member to make one full rotation.

8. An image forming method according to claim 1, wherein said image bearing member has a photosensitive layer, and is not subjected to charge removing exposure before image formation.

9. An image forming method according to claim 1, wherein an environment of an apparatus is detected, and the imparting of the charges of the opposite polarity before image formation is controlled on the basis of a result of the detection.

10. An image forming method according to claim 1, wherein a time from completion of last image formation is measured, and the imparting of the charges of the opposite polarity before image formation is controlled on the basis of the measured value.

* * * * *

UNITED STATES PATENT AND TRADEMARK OFFICE

CERTIFICATE OF CORRECTION

PATENT NO. : 6,144,824
DATED : November 7, 2000
INVENTOR(S) : Kouichi Hashimoto, et al.

It is certified that error appears in the above-identified patent and that said Letters Patent is hereby corrected as shown below:

Column 2,
Line 4, "each-of" should read -- each of --.

Column 5,
Line 2, "is appeared." should read -- appears. --.

Column 7,
Line 2, "Therefore" should read -- There --.

Column 11,
Line 39, "of" (first occurrence) should be deleted.

Column 15,
Line 9, "becomes" should read -- become --.

Signed and Sealed this

Thirtieth Day of October, 2001

*Attest:*

Nicholas P. Godici

NICHOLAS P. GODICI
*Acting Director of the United States Patent and Trademark Office*

*Attesting Officer*